US005113110A

United States Patent [19]

Jang

[11] Patent Number: 5,113,110

[45] Date of Patent: May 12, 1992

[54] DISPENSER CATHODE STRUCTURE FOR USE IN ELECTRON GUN

[75] Inventor: Dong-Gil Jang, Seoul, Rep. of Korea

[73] Assignee: Samsung Electron Devices Co., Ltd., Kyunggi, Rep. of Korea

[21] Appl. No.: 633,529

[22] Filed: Dec. 31, 1990

[30] Foreign Application Priority Data

Dec. 31, 1989 [KR] Rep. of Korea ..... 89-20770

[51] Int. Cl.[5] ..... H01J 29/04; H01J 19/22

[52] U.S. Cl. ..... 313/270; 313/337; 313/346 DC

[58] Field of Search ..... 313/346 DC, 270, 337

[56] References Cited

U.S. PATENT DOCUMENTS 3,159,461 12/1964 MacNair ..... 313/346 DC
3,441,779 4/1969 Hubner ..... 313/337 X
3,495,121 2/1970 Katz ..... 313/346 DC X
3,495,122 2/1970 Hubner et al. ..... 313/337 X
4,165,473 8/1979 Falce ..... 313/346 DC X
4,400,648 8/1983 Taguchi et al. ..... 313/346 DC X
4,737,679 4/1988 Yamamoto et al. ..... 313/346
4,823,044 4/1989 Falce ..... 313/346 DC

*Primary Examiner*—Palmer C. DeMeo
*Attorney, Agent, or Firm*—Cushman, Darby & Cushman

[57] ABSTRACT

A dispenser cathode for an electron gun comprises a reservoir for holding thermoelectron emissive material. A sleeve having an outward flange at a top portion thereof and receives the reservoir at the upper portion thereof and receives a heating element at the other end. A heat shielding tube is provided with an inward flange at the top thereof that overlaps and is welded to the outward flange of the sleeve. A holder for supporting the heat shielding tube is secured thereto.

6 Claims, 3 Drawing Sheets

DISPENSER CATHODE STRUCTURE FOR USE IN ELECTRON GUN

FIELD OF THE INVENTION

The present invention relates to a cathode structure for use in an electron gun, and, more particularly, to the improved structure of a dispenser cathode for use in a color cathode ray tube.

BACKGROUND OF THE INVENTION

In U.S. Pat. Nos. 4,165,473, 4,400,648, 4,737,679, and 4,823,044, the conventional dispenser cathode structures used in electron guns are explained in detail. There are two types of dispenser cathodes for electron guns, an impregnated cathode and a cavity reservoir type cathode. U.S. Pat. Nos. 4,165,473, 4,400,648, and 4,737,679 relate to the impregnated cathode, and U.S. Pat. No. 4,823,044 relates to the cavity reservoir type cathode.

The structures of impregnated cathodes are shown in FIGS. 1 and 2. In the impregnated cathode, as illustrated in FIG. 1, thermoelectron emissive material is impregnated in a porous base 1 which is made of a heat resistance material, such as tungsten. The porous base is a thermoelectron emissive source and is contained within a reservoir 2 in the form of a cup. This reservoir 2 is disposed within the upper portion of a sleeve 3, which also receives a heater 6. Sleeve 3, is supported by a holder 4 connected to the lower portion thereof, and is enclosed by a large-caliber heat shielding tube 5.

The construction of another similar impregnated dispenser cathode is illustrated in FIG. 2. This impregnated dispenser cathode comprises a reservoir 2 containing a porous base 1, a sleeve 3 for supporting and securing the reservoir 2 and for receiving a heating element 6, a suspending ribbon 8 whose lower portion is welded to the lower end of the sleeve 3 and whose upper portion is welded to the upper end of a large-diameter holder 4, and a heat shielding tube 5 which surrounds the sleeve 3 and which is welded to the holder 4.

On the other hand, a cavity reservoir type cathode has a thermoelectron emissive source different from the aforesaid porous base which is contained in the cup-shaped reservoir. The thermoelectron emissive source of the cavity reservoir type cathode comprises thermoelectron emissive material such as tungsten, barium calcium aluminate, etc. and is contained in a reservoir disposed within the upper portion of the sleeve.

The dispenser cathodes having the above-mentioned constructions have much higher current density than that of an ordinary oxide cathode ray tube, and are adapted to be used in an electron gun of a large-scale cathode ray tube or a projecting tube, for example. However, in the electron gun having a conventional dispenser cathode, the voltage characteristics during initial operation are poor and the radiating state of the electron beam is unstable. These problems are caused because an thermoelectron emissive source of the conventional dispenser cathode, i.e. a porous base, is positioned adjacent and in front of a first electrode of an electron gun. During initial operation, the electron beam more rapidly approaches the first electrode. This rapid approach of the electron beam to the first electrode is a result of structural defects in the cathode.

More specifically, as shown in FIGS. 1 AND 2, the sleeve 3 supported by a holder 4 and receiving a heater 6 thermally expands toward the first electrode. If the sleeve expands and the cathode approaches the first electrode, the cut-off voltage used to control the electron beam varies abnormally. As a result, the white balance of the image fails.

In all electron guns, it is inevitable that some parts of the cathode will shift by thermal expansion. In the conventional cathode ray tube, to obviate this problem, the thermal deformation of the cathode is taken into account during generation of the cathode ray tube with various picture quality controls.

SUMMARY OF THE INVENTION

It is the object of the present invention to provide an improved dispenser cathode for use in an electron gun having a heating element, which can greatly improve withstand voltage characteristic and white balance.

To achieve the object of the invention, a dispenser cathode for an electron gun according to the present invention comprises a reservoir for holding thermoelectron emissive material a sleeve which is provided with an outward flange at the top thereof and receives said heating element and secures the reservoir within the upper portion, a heat shielding tube provided with an inward flange at the top thereof that corresponds to and overlaps with the outward flange of the sleeve and is welded thereto, and a holder for supporting and securing the heat shielding tube.

BRIEF DESCRIPTION OF THE DRAWING

The above object and other advantages of the present invention will become apparent in the following detailed description of the preferred embodiment of the present invention with reference to the attached drawings, in which.

DETAILED DESCRIPTION OF PREFERRED EMBODIMENTS

Figure 3:
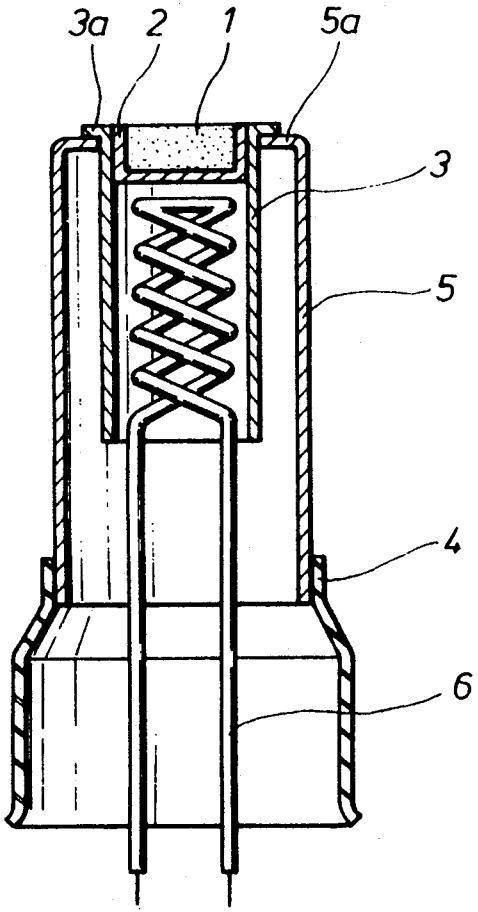
FIG. 3 is a sectional view of a preferred embodiment of the dispenser cathode according to the present invention.

In the dispenser cathode of the present invention shown in FIG. 3, a porous base 1 impregnated with thermoelectron emissive material is contained within a reservoir 2. The reservoir 2 is inserted into and fixed to the upper portion of a sleeve 3 which is provided with an outward flange 3*a* at the top thereof and receives a heating element 6. A heat shielding tube 5 of larger diameter is provided with an inward flange 5*a* at the top thereof corresponding to the outward flange 3*a* of the sleeve 3. The heat shielding tube 5 encloses the sleeve 3 with the flange 3*a* welded to the flange 5*a*. The heat shielding tube 5 is also secured to and supported by a holder 4 disposed below the shielding tube 5.

Figure 1:
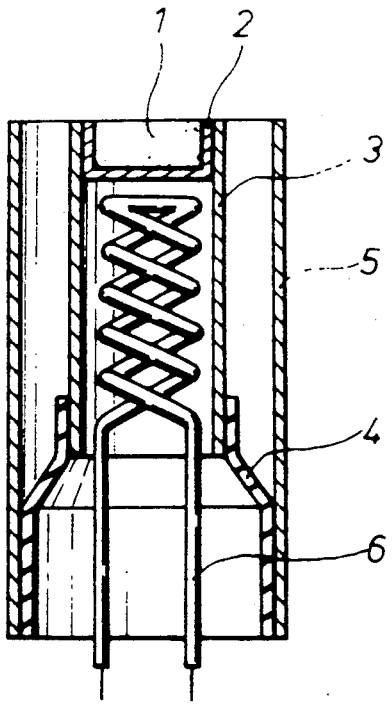
FIG. 1 PRIOR ART
FIGS. 1 and 2 are sectional views of conventional impregnated cathodes.
Figure 2:
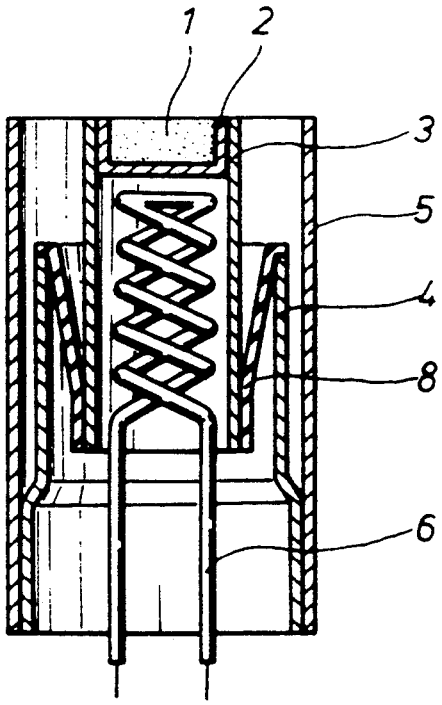
FIG. 2 PRIOR ART
Figure 4:
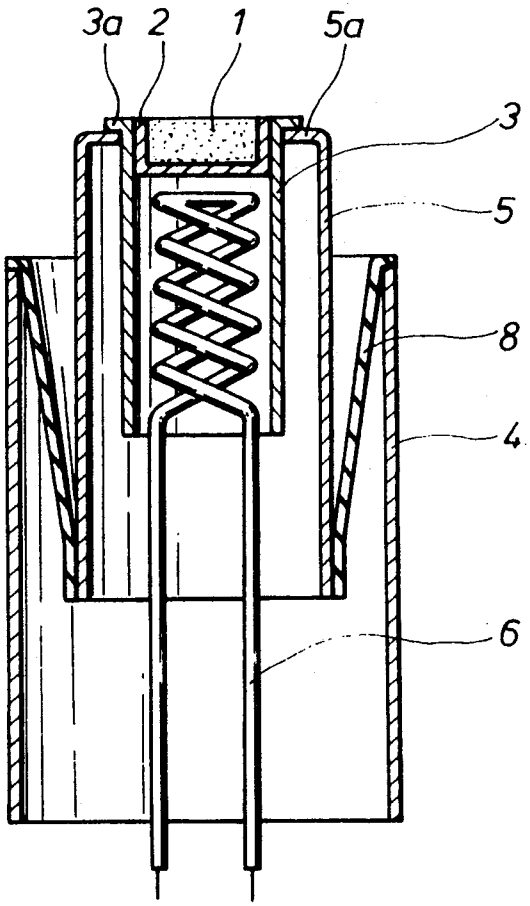
FIG. 4 is a sectional view of another preferred embodiment of the dispenser cathode according to the present invention.

In another dispenser cathode of the present invention shown in FIG. 4, a porous base 1 impregnated with thermoelectron emissive material is disposed within a reservoir 2. The reservoir 2 is inserted into and secured to the upper portion of a sleeve 3 which is provided with an outward flange 3*a* at the top thereof. The flange 3a of sleeve 3 overlaps and is welded and secured to an inwardly formed flange 5a of the larger diameter heat shielding tube 5. The heat shielding tube 5 is supported and fixed to a holder 4 by a suspending ribbon 8, the lower end of which is welded to the lower portion of the heat shielding tube 5 and the upper end of which is welded to the upper end of the holder 4.

Figure 5:
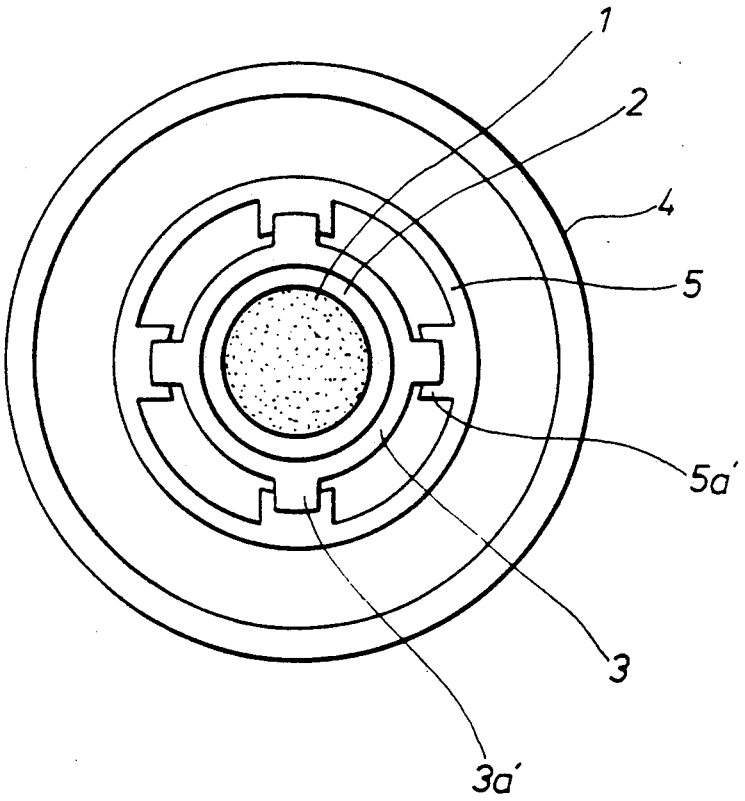
FIG. 5 is a sectional view of still another embodiment of the dispenser cathode of the present invention.

In the above preferred embodiments, the outward flanges 3a and inward flanges 5a are respectively formed on the sleeve 3 and on the heat shielding tube 5, along the entire top circumferences thereof. However, they can be formed locally in such a manner that a plurality of fragmentary flanges 3a' and 5a' can be formed at the corresponding positions, as illustrated in FIG. 5, for example.

It should be noted that with a dispenser cathode according to the present invention, the top end of the sleeve is fixed to the top end of the heat shielding tube and lower end of the sleeve is kept free. Accordingly, when the sleeve undergoes thermal expansion it expands in a direction opposite to the location of the first electrode of an electron gun. As a result, the relative movement between the porous base and the first electrode of an electron gun is minimized. Moreover, when the sleeve and heat shielding tube of the dispenser cathode have fragmentary flanges, the heat transfer through the flanges is decreased, so that the shifting of the cathode by heat deformation is minimized.

According to the present invention, the change in the cutoff characteristic of the electron gun is reduced during initial operation of the cathode ray tube. Thus, stabilization of the operational characteristic of the electron gun occur as soon as possible, and the white balance of the image is improved. In other words, it is possible to manufacture an electron gun having few characteristics during initial operation, and it is also possible to provide a cathode ray tube having a stable initial operation characteristic and stable picture quality.

The above mentioned preferred embodiments of the present invention concentrates on the impregnated cathode type dispenser cathode in detail. However, the present invention can also be used with cavity reservoir type cathodes. As such, various modifications and equivalent arrangements are possible and the description of the preferred embodiments should not be construed in a limiting sense. Rather, the proper scope of the present invention and equivalent structures should be interpreted in accordance with the following claims.

What is claimed is:

1. A frame structure for a dispenser cathode having a thermoelectron emissive material and a heater for use in an electron gun comprising:

a cup-shaped reservoir for holding thermoelectron emissive material;

a sleeve having an outward flange at an upper sleeve portion thereof, an inner surface of said upper sleeve portion enclosing said reservoir;

a heat shielding tube having an inward flange at an upper shield portion thereof, said outward flange of said sleeve connectedly overlapping said inward flange of said heat shielding tube; and means for securing said heat shielding tube to an outer wall surface of said outward flange.

2. A frame structure according to claim 1 wherein said outward flange of said sleeve and said inward flange if said shield are welded together.

3. A frame structure according to claim 1 wherein said outward flange comprises a first number of alternately disposed fragmentary outward flanges and said inward flange comprises a second number, equal to said first number, of alternately disposed fragmentary inward flanges, each fragmentary outward flange being secured to a respective fragmentary inward flange.

4. A frame structure for use in an electron gun of the type having a thermoelectron emissive material and a heater, comprising:

reservoir means having a cup shape for holding a thermoelectron emissive material;

a sleeve for receiving said reservoir means and having an outwardly extending flange at a forward end thereof;

a heat shielding tube for receiving said sleeve and having an inwardly extending flange that overlaps said outwardly extending flange, said inwardly and outwardly extending flanges being secured to one another; and means for securing said heat shielding tube to an outer wall surface of said outwardly extending flange.

5. The frame structure of claim 4, wherein said inwardly and outwardly extending flanges are secured by welding.

6. The frame structure of claim 5, wherein said inwardly and outwardly extending flanges are each configured as having alternately disposed discontinuous flange segments, the respective segments of said inwardly extending flange being secured to a corresponding segment of said outwardly extending flange.

* * * * *